US006196549B1

(12) United States Patent
Bennett

(10) Patent No.: US 6,196,549 B1
(45) Date of Patent: Mar. 6, 2001

(54) APPARATUS AND METHOD OF PLAYING A POEM COMPLETION GAME

(75) Inventor: Stephen D. Bennett, Grinnell, IA (US)

(73) Assignee: Crosley-Griffith Corporation, Grinnell, IA (US)

( * ) Notice: Subject to any disclaimer, the term of this patent is extended or adjusted under 35 U.S.C. 154(b) by 0 days.

(21) Appl. No.: 09/455,238

(22) Filed: Dec. 6, 1999

(51) Int. Cl.[7] ..... A63F 1/00
(52) U.S. Cl. ..... 273/299; 273/432
(58) Field of Search ..... 273/292, 299, 273/300, 430, 431, 432

(56) References Cited

U.S. PATENT DOCUMENTS

| | | | |
|---|---|---|---|
| 2,520,649 | | 8/1950 | Northrop . |
| 3,779,557 | | 12/1973 | Kritzberg et al. . |
| 4,090,717 | * | 5/1978 | Rossetti . |
| 4,116,449 | * | 9/1978 | Breslow . |
| 4,326,711 | * | 4/1982 | Giallomgardo . |
| 4,671,516 | | 6/1987 | Lizzola et al. . |
| 4,889,344 | * | 12/1989 | Zimba . |
| 5,100,154 | | 3/1992 | Mulllins . |
| 5,112,064 | | 5/1992 | Weedman . |
| 5,375,846 | | 12/1994 | Smith . |
| 5,441,277 | | 8/1995 | Lenhart et al. . |
| 5,478,120 | * | 12/1995 | D'Andrea . |
| 5,547,199 | * | 8/1996 | Calhoun . |
| 6,019,370 | * | 2/2000 | Morris . |

* cited by examiner

*Primary Examiner*—Benjamin H. Layno
*Assistant Examiner*—V K Mendiratta
(74) *Attorney, Agent, or Firm*—Zarley, McKee, Thomte, Voorhees & Sease

(57) ABSTRACT

A game apparatus and method for playing the game comprising a verse booklet, a plurality of instruction cards, each with a different instruction imprinted thereon and a scoring means. The game is played by selecting an existing partial verse. Then, an instruction card is drawn from a plurality of instruction cards, which outlines how the partial verse is to be completed. A player then completes the poem under a time constraint. Then, the completed verse is scored by opposing players. Finally, the steps are repeated until the game is completed.

15 Claims, 2 Drawing Sheets

APPARATUS AND METHOD OF PLAYING A POEM COMPLETION GAME

BACKGROUND OF THE INVENTION

This invention relates to an apparatus and method for playing a game, specifically a game wherein players complete poems from an unfinished verse in an interesting, creative, and/or entertaining way.

Many games are known wherein players complete sentences, stories, or a rhyme. As an example, a sentence game as described in U.S. Pat. No. 5,547,199 by Calhoun, requires a player to complete a sentence based on a combination of instructions from a plurality of cards with sentences and a plurality of cards with pictorial elements. U.S. Pat. No. 4,671,516 by Lizzola et al. teaches a method of playing a sentence game where first a plurality of cards are distributed bearing indicia representing words as well as values, next an original player makes a sentence based on the indicia, and finally subsequent players try to make sentences that improve upon the original player's sentence.

A further game as shown in U.S. Pat. No. 5,100,154 by Mullins teaches a method of playing a game where participants start a short story under time constraints and then pass the story to another participant who then adds to the original story.

Finally, U.S. Pat. No. 5,441,277 by Lenhart requires a player to satisfactorily comply with instructions that combine with categories on a game board to solicit a rhyming response that allows a player to advance around the game board to a winning position. The categories are limited to a defined group.

While many educational and skill-testing games are known, a need exists for a game that enhances an individual's creative and poetic skill that is entertaining and also utilizes an existing verse with specific instructions on completing the verse, and a means for allowing opposing players to score the individual's completed poem. Therefore, the primary object of the present invention is to create a game that utilizes an existing verse and a plurality of instruction cards for completing the verse.

A further object is to provide a game that enhances the creative and poetic skills of the players.

A further object is to create a game that is adaptable to a variety of formats.

A still further object of the present invention is to create a game that is entertaining and intellectually challenging to the player.

These and further objects will become apparent from the following description.

SUMMARY OF THE INVENTION

This invention relates to a game apparatus and method for playing the game comprising a verse booklet; a plurality of instruction cards, each with a different instruction imprinted thereon, and a scoring means. The game starts when a player selects an existing partial verse from a booklet, draws an instruction card from the set of cards and completes the verse in compliance with the instruction on the instruction card. Once completed, the verse is scored by opposing players based on quality, compliance, and creativity.

A BRIEF DESCRIPTION OF THE DRAWINGS

DETAILED DESCRIPTION OF THE INVENTION

Figure 1:
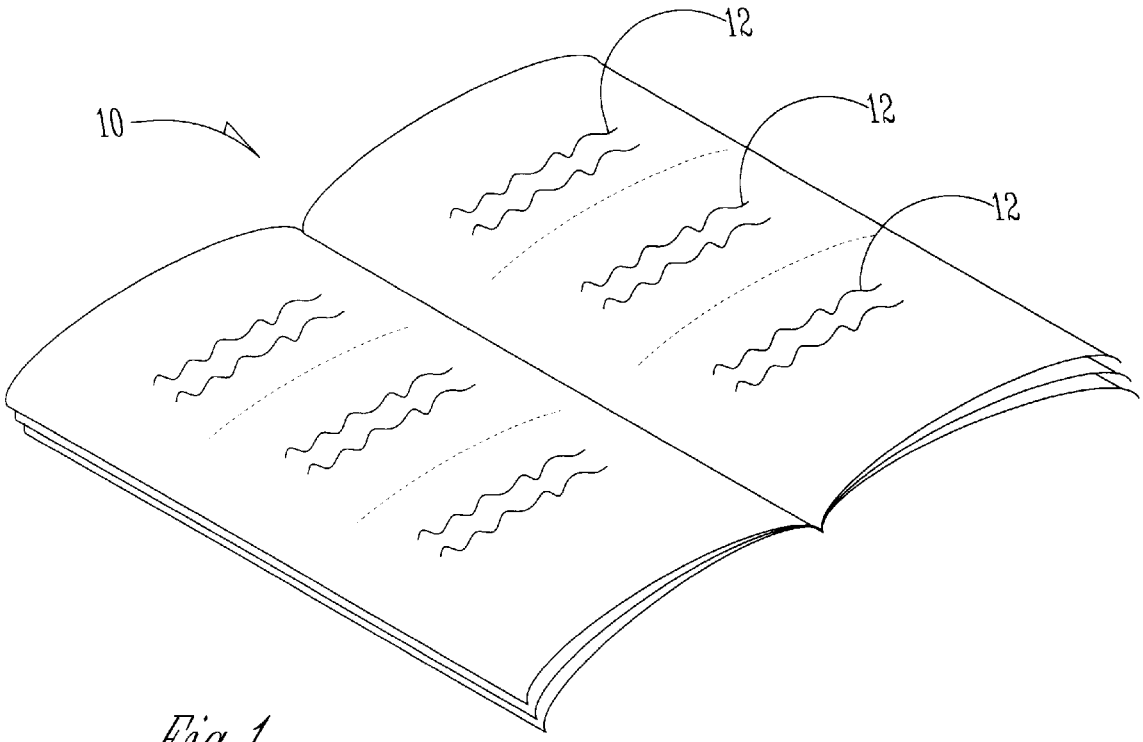
FIG. 1 is a perspective view of a verse book.
Figure 2:
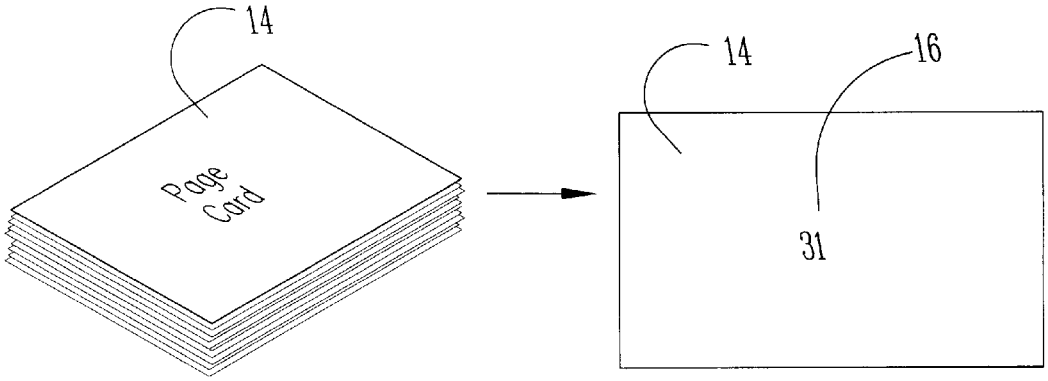
FIG. 2 is a perspective view of a plurality of page cards with an example of a numerical indicia imprinted on one side.
Figure 3:
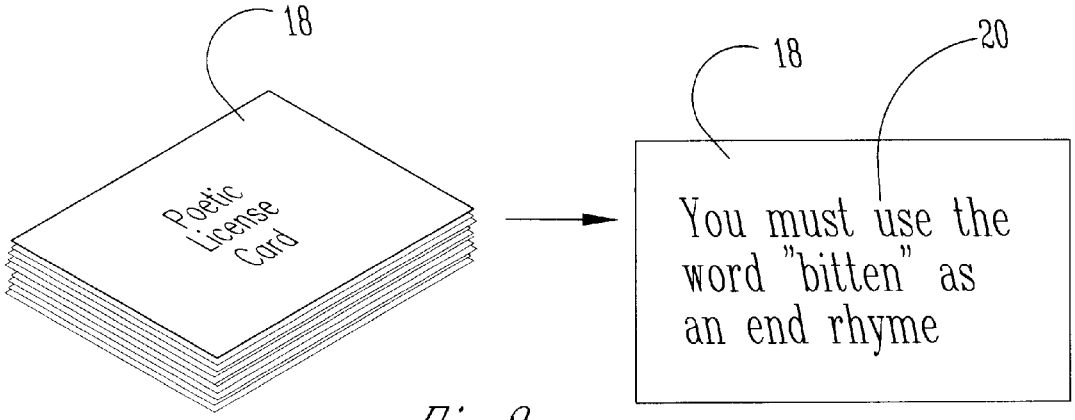
FIG. 3 is a perspective view of a plurality of instruction cards with an instruction imprinted on one side of one card.
Figure 4:
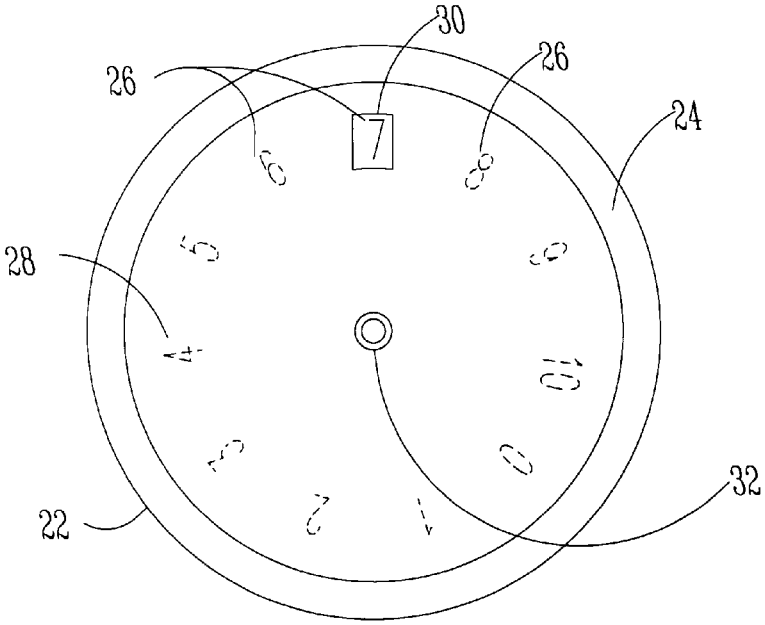
FIG. 4 is a top view of a scoring device.

The game of the present invention can be played in a variety of formats. While described herein as a conventional tabletop game, the game can be adapted for play on CD-ROM, television, radio, the Internet and at public competitions. The game playing apparatus comprises a booklet 10 with a plurality of poem verses 12 imprinted in the booklet 10. The poem verses 12 are portions of existing poems. While the verses 12 can come from any source, lines from famous poets such as Byron, Tennyson, and Rossetti are preferred over whimsical poets such as Nash and Dr. Seuss as part of the entertainment value of the game is making a verse 12 by Byron sound like a verse 12 from Dr. Seuss. Further, while a single partial verse can be imprinted on each page of the booklet 10, it is preferred that a plurality of partial verses 12 are imprinted on each page with each verse 12 having varying degrees of complexity. Three partial verses 12 are ideal with the verse 12 positioned at the top of the page being the easiest, the verse 12 positioned in the middle of the page being slightly more complex, and the verse 12 at the bottom of the page being the most difficult. However, the complexity of the verses 12 can be in any order.

In one embodiment of the game apparatus, a plurality of page cards 14, each having imprinted on one side a different numerical indicia 16 that corresponds to a page number within the booklet 10, are used to assist in selecting the poem verse 12.

The game apparatus also comprises a plurality of instruction cards 18 each having imprinted on one side a different instruction indicia 20 that provides a player with an instruction on how he or she is to complete the preselected verse 12 that is identified in the booklet 10. Once a player completes the verse 12 based on the instruction 20, opposing players score the completed verse. In the game apparatus, a scoring dial 22 is used to score the completed verse having a back member 24 with numerical indicia 26 imprinted radially on the outer perimeter of the back member 24 and an inner member 28 that is rotatably connected to the back member 24 by a pin 32 about a central axis. The numerical indicia 26 range from 0 to 10. The inner member 28 has an opening cut on its outer perimeter that aligns with various numerical indicia 26 on the back member 24 to indicate the score given by an opposing player.

The method of playing the game by a plurality of players begins by selecting a poem verse 12. While a verse 12 can be selected from any source by any random means, when using the booklet 10, the active player selects a verse 12 by choosing a random page number from the booklet. The page number for the booklet 10 can also be determined by having an active player select a page card 14 with a numerical indicia 16 that corresponds with a page number in the booklet 10. If a booklet 10, having a plurality of verses 12 on each page of the booklet 10 is used, the active player declares aloud the position of the verse 12 on the page that will be used prior to drawing the page card 14. If three verses 12 are used on each page, then the active player would declare either "Top", "Middle", or "Bottom".

Once the verse 12 is selected, the active player reads the verse aloud so all players are in agreement as to which verse 12 will be used. Then the active player draws an instruction card 16 from a plurality of cards 16 and reads the instruction 18 aloud.

The active player then completes the pre-selected verse 12 by following the instruction 18 on the selected card 16. The verse 12 can be used anywhere in the completed verse. In the preferred embodiment, the active player completes the verse under a time constraint. The optimum amount of time allotted to the active player is three and one-half minutes. Also preferred is to have non-active players complete the same pre-selected verse 12 following the same instruction 18 under the same time constraint simultaneously as the active player.

Once completed, the active player reads his or her completed verse aloud. The non-active players then score the active players completed verse on a scale of zero to ten based on originality, creativity, quality, and compliance with the instruction 18. Non-active players can score the active player by announcing the score aloud, writing the score on a piece of paper, or using the scoring dial 22. Once the scores are given, they are added up and recorded. If non-active players have completed the verse simultaneously, each player, beginning with the active player and continuing clockwise is scored. The subjective judging adds to the entertainment value of the game and encourages players to score fairly, as they will be subjected to the same process.

These steps are repeated until the game is completed. A game is completed when a player reaches a predetermined cumulative score or when a predetermined number of rounds are completed. A round is completed when all participating players have completed a verse.

On CD-ROM, the game is played in the same way. However, the CD would contain complete versions of every source poem and sheets would be printed from the source for each player with a partial verse 12 and the instruction 18 on each sheet.

For television and radio, the game is also played the same way. However, instead of booklets 10 with verses 12 these items could be replaced with preprinted sheets similar to those used for the CD-ROM version. Because of the time constraints of television and radio, it is preferred that a plurality of games be played simultaneously. While one group of players is completing their verses, other players could be introduced. As rounds progress, one group could then compose a verse while the other group would read aloud completed verses and the completed verses would be scored. Further, due to time constraints, in a half-hour format there would be time for only one preliminary round, with the top score in each preliminary round advancing to a final showdown round. The top score in the showdown round would win the game. The scoring also could be adjusted to allow audience participation. Further, the scoring also could be conducted by a plurality of celebrity judges. The daily winner could come back the next day to defend his or her title. If a player were to win five consecutive days, he or she, as undefeated champion, would be entitled to return for a tournament of champions at the end of the year.

For public tournaments, the game would be played in the same way. The tournament version would be similar to the television or radio version except that instead of two interwoven games, a single game would be played.

The game also could be adapted for play on the Internet. Play would be conducted in an on-line room, with up to sixteen people in the room. The game would be limited to eight participants. Non-participants could queue and wait for an opening in the game. If there is a queue waiting to play, then the bottom two scores from a round could be eliminated and the first two queues in line would be allowed to join the game. Completed verses would be displayed on a scrolling list and scored by all other participants. A player would not be allowed to score his or her own verse.

As can be seen from this description, the primary object of the present invention has been satisfied as a game that utilizes an existing verse and a plurality of instruction cards for completing the verse has been described.

The preferred embodiment of the present invention has been set forth in the drawings and specification. Although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A poem composition game playing apparatus comprising:

a plurality of partial poem verses imprinted on a plurality of pages in a booklet;

a set of cards each having imprinted on one side an instruction on how a player is to complete the verse, each of the cards having a different instruction imprinted thereon; and a mechanical means of scoring based on compliance with the instruction of the completed verse on a scale of 0 to 10.

2. The game apparatus of claim 1 further comprising a plurality of page cards, each having imprinted on one side a numerical indicia that corresponds to a page number of the booklet, each of the page cards having a different number imprinted thereon.

3. The game apparatus of claim 1 or 2 wherein the means of scoring comprises an outer circular wheel having numerical indicia radially imprinted around the perimeter of the wheel, and an inner circular wheel rotatably connected to the outer wheel about a central axis having a diameter less than the outer wheel and an opening on the perimeter of the inner wheel that aligns with the numerical indicia of the outer wheel.

4. The game apparatus of claim 1 wherein a plurality of poem verses are imprinted on the plurality of pages of the booklet.

5. The method of playing a poem composition game by a plurality of players comprising the steps of:

selecting a partial poem verse by an active player;

drawing a card by the active player from a first set of cards having an instructional indicia imprinted on one side of each card, each card having a different instruction imprinted thereon;

completing the poem verse by the active player by following the instruction from the drawn card;

scoring the completed poem verse by non-active players comprised of all players except the active player based on the active player's compliance with the instruction which completes a round; and repeating the steps with a different active player selected from the plurality of players until a predetermined number of rounds are completed.

6. The method of claim 5 wherein non-active players complete the poem verse by incorporating the instruction from the drawn card simultaneously as the active player completes the same.

7. The method of claim 5 wherein the active player selects a poem verse from a booklet having the poem verse imprinted on a plurality of pages of the booklet.

8. The method of claim 7 wherein the active player selects a poem verse by drawing a page card from a plurality of page cards, each having imprinted on one side a numerical indicia that corresponds to a page number of the booklet, each of the page cards having a different number imprinted thereon.

9. The method of claim 5 or 8 wherein the active player selects a poem verse from a booklet having a plurality of poem verses imprinted on a plurality of pages of the booklet.

10. The method of claim 5 wherein the active player completes the poem verse under a time constraint.

11. A method of playing a poem composition game by a plurality of players;

selecting an active player from among the plurality of players with the remaining players being inactive players;

causing the active player to use from a plurality of partial poem verses a single partial poem verse;

causing the active player to draw from a plurality of words a special word;

causing the active player to randomly select from a plurality of instructions a special instruction as to how the special word should be incorporated into the special poem verse;

causing the active player to follow the special instruction to incorporate the special word into the special poem verse;

causing the inactive players to grade and to score the quality or merit of the incorporation of the special word into the special poem verse according to the special instruction;

causing a plurality of inactive players to thereafter sequentially serve as an active player, and thereupon sequentially repeating the foregoing steps; and thereafter declaring a game winner by tabulating the comparative scores of the players who have served as active players.

12. The method of claim 11 wherein the active player selects a poem verse from a booklet having the poem verse imprinted on a plurality of pages of the booklet.

13. The method of claim 12 wherein the active player selects a poem verse by drawing a page card from a plurality of page cards, each having imprinted on one side a numerical indicia that corresponds to a page number of the booklet, each of the page cards having a different number imprinted thereon.

14. The method of claim 11 wherein the active player selects a poem verse from a booklet having a plurality of poem verses imprinted on a plurality of pages of the booklet.

15. The method of claim 11 wherein the active player completes a poem verse under a time constraint.

* * * * *